US008925462B2

(12) United States Patent
Biggs et al.

(10) Patent No.: US 8,925,462 B2
(45) Date of Patent: Jan. 6, 2015

(54) INTERMEDIATE VOLTAGE ARMING

(75) Inventors: Bradley M. Biggs, Corona, AZ (US); Tim Bonbrake, Tucson, AZ (US); Nicole Quackenbush, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 13/534,740

(22) Filed: Jun. 27, 2012

(65) Prior Publication Data

US 2014/0000470 A1 Jan. 2, 2014

(51) Int. Cl.
*F42C 15/40* (2006.01)

(52) U.S. Cl.
CPC ..... *F42C 15/40* (2013.01)
USPC ..... 102/262; 102/215

(58) Field of Classification Search
USPC ..... 102/200, 206, 215, 262, 264
See application file for complete search history.

(56) References Cited

U.S. PATENT DOCUMENTS

| | | | |
|---|---|---|---|
| 5,245,926 | A | 9/1993 | Hunter |
| 6,729,240 | B1 | 5/2004 | Smith et al. |
| 6,732,656 | B1 | 5/2004 | Heyse et al. |
| 2005/0178282 | A1 | 8/2005 | Brooks et al. |
| 2008/0083344 | A1 | 4/2008 | Deguire et al. |

OTHER PUBLICATIONS

International Search Report of the International Search Authority for corresponding PCT Application Serial No. PCT/US13/37682, Aug. 16, 2013, pp. 1-21.
Written Opinion of the International Searching Authority for corresponding PCT Application Serial No. PCT/US13/37682, Aug. 16, 2013, pp. 1-9.

*Primary Examiner* — James S Bergin
(74) *Attorney, Agent, or Firm* — Cantor Colburn LLP

(57) ABSTRACT

A system includes a first arm switch, a voltage multiplier device connected in series with the first arm switch, and a first intermediate voltage detector portion communicatively connected to the sequence of events logic portion, the first intermediate voltage detector portion operative to determine whether a first voltage signal is greater than a first threshold voltage value and responsive to determining that the first voltage signal is greater than the first threshold voltage value affect an actuation of the first arm switch and output a first arm signal.

7 Claims, 7 Drawing Sheets

INTERMEDIATE VOLTAGE ARMING

BACKGROUND

The present invention relates to arming systems.

Arming systems may be used to safely arm a variety of systems such as, for example, ordinance, rockets, or missiles. Such arming systems often include a variety of sensors and mechanisms that operate in a sequence to prevent undesired arming and/or ignition of the systems.

SUMMARY

According to one embodiment of the present invention, a system includes a first arm switch, a voltage multiplier device connected in series with the first arm switch, and a first intermediate voltage detector portion communicatively connected to the sequence of events logic portion, the first intermediate voltage detector portion operative to determine whether a first voltage signal is greater than a first threshold voltage value and responsive to determining that the first voltage signal is greater than the first threshold voltage value affect an actuation of the first arm switch and output a first arm signal.

According to another embodiment of the present invention, an arming system includes a first arm switch, an inductive device connected in series with the first arm switch, a second arm switch connected in series with the inductive device, a third arm switch connected in series with the second arm switch, a sequence of events logic portion operative to receive a first arm signal and a second arm signal and determine whether the first arm signal was received prior to receiving the second arm signal and affect an actuation of the second arm switch responsive to determining that the first arm signal was received prior to receiving the second arm signal, a first logic portion operative to perform a first logic routine and output a first signal, a first intermediate voltage generator portion communicatively connected to the first logic portion, the first intermediate voltage generator portion operative to receive the first signal and output a first intermediate voltage signal, and a first intermediate voltage detector portion communicatively connected to the first intermediate voltage generator portion and the sequence of events logic portion, the first intermediate voltage detector portion operative to determine whether the first intermediate voltage signal is greater than a first threshold voltage value and responsive to determining that the first intermediate voltage signal is greater than the first threshold voltage value affect an actuation of the first arm switch and output the first arm signal to the sequence of events logic portion.

According to another embodiment of the present invention, a method for controlling an arm and fire device includes receiving a first signal having a first voltage, determining whether the first voltage is greater than a first threshold value, actuating a first arm switch responsive to determining that the first voltage is greater than the first threshold value, receiving a second signal having a second voltage, determining whether the second voltage is greater than a second threshold value, actuating a second arm switch responsive to determining that the second voltage is greater than the second threshold value, determining whether the first signal was received prior to receiving the second signal, and actuating a third arm switch responsive to determining that the first signal was received prior to receiving the second signal.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Previous systems used coded signals to control arming in a remotely located arm and fire device. Detectors for coded signals have many parts due to the complexity of the coded arm signal. Other systems used alternating current voltages over 500 volts to charge a remotely located capacitor for initiating more than one warhead in a system. Voltages over 500 volts use high voltage connectors and wiring with high voltage insulation, which can be larger and more costly than low voltage connectors and wiring. Some systems used multiple fuzes to safe and arm multiple warheads or rockets in a system. Multiple complete fuzes increase the size, weight, and cost of a system over a system with fewer fuzes and arm and fire devices.

The embodiments described below include an intermediate voltage generator and at least one intermediate voltage detector. The detector may include a single component, such as, for example, a zener diode. The intermediate voltage is less than 500 volts, which facilitates the use of low voltage connectors and wiring.

Figure 1:
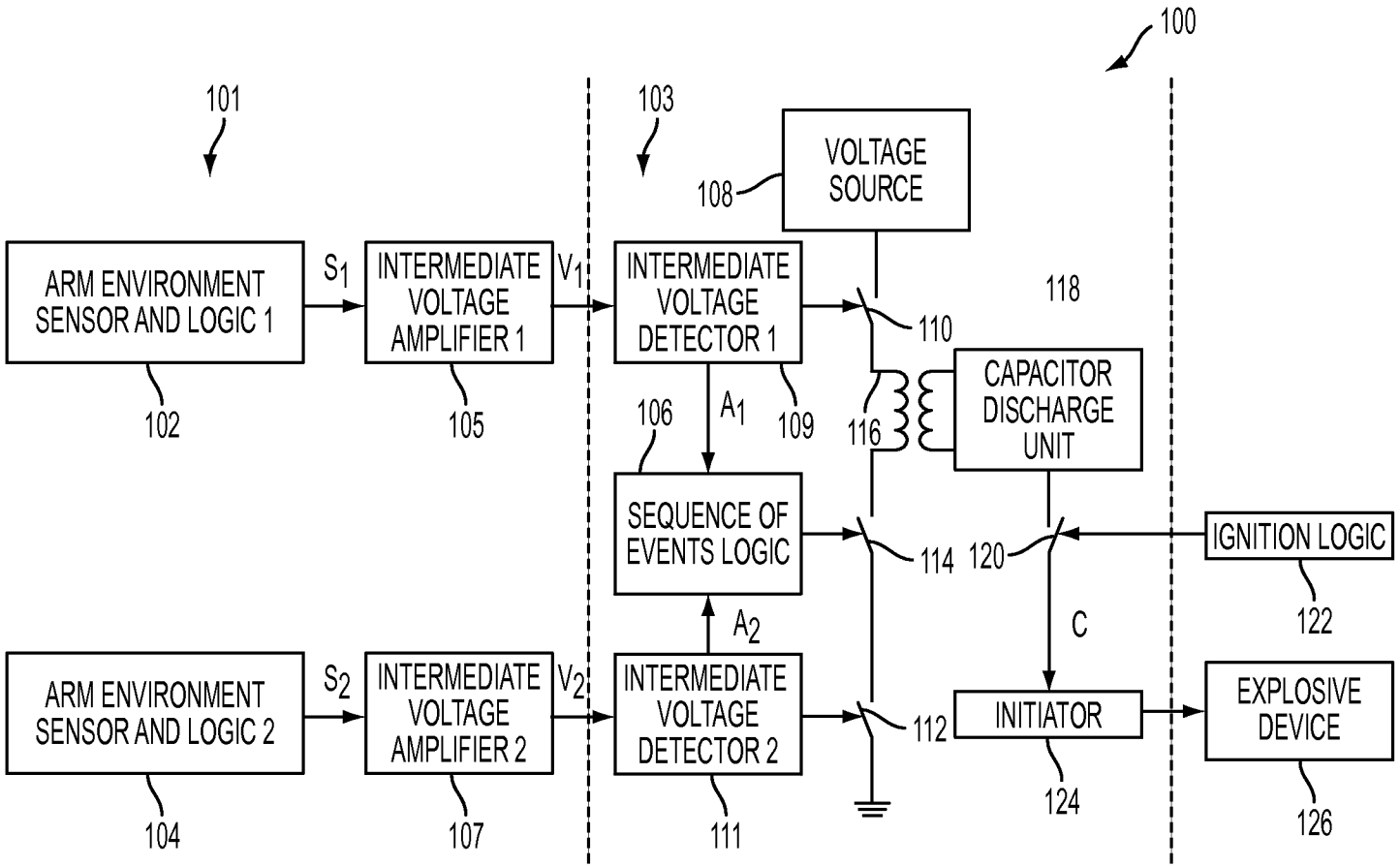
FIG. 1 illustrates a block diagram of a system.

In this regard, FIG. 1 illustrates a block diagram of a system 100 that is operative to ignite an explosive or combustive device 126 that may include, for example, detonator, energetic initiator, explosive ordinance or a rocket motor. In this regard, the system 100 includes an arm controller portion 101 that includes a first arm environment sensor and logic (AESL) portion 102 that is communicatively connected to a first intermediate voltage generator portion 105; and a second AESL portion 104 that is communicatively connected to a second intermediate voltage generator portion 107. The arm controller portion 101 is communicatively connected to an arm and fire device (AFD) 103. In this regard, the first intermediate voltage generator 105 is communicatively connected to a first intermediate voltage detector portion 109. The first intermediate voltage detector portion 109 is communicatively connected to a first arm switch 110 and a sequence of events logic portion 106. The second intermediate voltage generator portion is 107 communicatively connected to a second arm switch 112 and the sequence of events logic portion 106. An example intermediate voltage may be between the maximum battery voltage in a weapon system such as 5 volts and the minimum no-fire voltage of the initiator associated with the arming system such as 500 volts.

The sequence of events logic portion 106 is communicatively connected to a third arm switch 114. The first, second, and third arm switches 110, 112 and 114 are arranged in series with a voltage source 108 and a voltage multiplying or inductive device 116 that may include, for example a transformer or other inductive device. The inductive device 116 is communicatively connected to an initiator 124 via a capacitor discharge unit 118. The initiator may include for example, a priming charge or ignition device. The initiator is operative to receive a voltage from the capacitor discharge unit 118 and ignite or combust to affect the combustion of the explosive device 126. An ignition switch 120 may be disposed between the capacitor discharge unit 118 and the initiator 124 and communicatively connected to the ignition logic 122.

In operation, the arm environment sensor and logic (AESL) portions 102 and 104 are operative to receive inputs such as presence of an arm environment and/or removal of physical safety devices including umbilical cables, pins, lanyards, or switches that are arranged to change states following a physical input. Example arm environments include a pull force, folding weapon suspension lug, changing a magnetic environment, ejection shock, setback acceleration, set forward acceleration, etc. The arm environment sensor and logic portions often perform logical functions, using a logic device such as, for example, a field programmable gate array (FPGA) following the change of states of the physical safety devices. For example, the system 100 may be incorporated into bomb that may be delivered by an aircraft. In such an exemplary embodiment it is desirable to only arm the device if the device has been intentionally released from the aircraft, and has traveled a minimum distance from the aircraft. In this regard, the first AESL portion 102 may include a lanyard that is physically attached to the aircraft. When the bomb is released from the aircraft, the lanyard remains attached to the aircraft, and breaks away from the first AESL portion 102. Such a removal of the lanyard from the first AESL portion 102 may, for example open (or close) switch(es) located in the AESL portion 102. The removal of the lanyard initiates a logic routine that may be performed by, for example, a field programmable gate array to start a logic routine such as, for example, a timer. Once the timer has expired, the AESL portion 102 outputs a signal ($S_1$) to the intermediate voltage generator portion 105. The intermediate voltage generator portion 105 outputs an amplified signal to the first intermediate voltage detector 109. The amplified signal is greater than pre-arm voltages in the system. An example pre-arm voltage is a battery voltage. The first intermediate voltage detector 109 is operative to determine whether the received signal from the first intermediate voltage generator 105 is above a threshold voltage level and responsive to determining that the signal is above the first threshold level, output a signal to the sequence of events logic portion 106 and actuate the first arm switch 110 to close the first arm switch 110.

The second AESL portion 104 operates in a similar manner as the first AESL portion 104 by receiving an external input, and performing a logical function following the receipt of the external input. For example a second lanyard may be removed to start the logic functions of the second AESL portion 104. The logic functions of the second AESL portion 104 may include, for example, receiving inputs from an accelerometer, pressure sensor, air powered alternator, spin sensor, or other type of sensor to determine whether the bomb is indeed falling. When the logic has been completed and satisfied in the second AESL portion 104, the second AESL portion 104 sends a signal ($S_2$) to the second intermediate voltage generator 107 the second intermediate voltage generator 107 amplifies the signal and outputs an amplified signal to the second intermediate voltage detector 111. The second intermediate voltage detector 111 is operative to determine whether the received amplified signal is greater than a threshold level and responsive to determining that the signal is greater than the threshold level, output a signal to the sequence of events logic and an actuation signal to actuate the third arm switch 112.

The examples of the actuation and logical functions of the AESL portions 102 and 104 are mere examples. The exemplary embodiments described herein may use any type of actuation method or arrangement including any type of desired logic that is operative to affect an arming sequence.

In the illustrated embodiment, the signals output from the first intermediate voltage generator 105 and the second intermediate voltage generator 107 ($V_1$ and $V_2$ respectively) are dissimilar signals. For example, the signals may have voltages of different polarities, different levels, or combination. Intermediate voltages may also differ by frequency, different duty cycle, or combination. The intermediate voltage detectors 109 and 111 are each designed with dissimilar detection threshold values ($T_1$ and $T_2$ respectively) that correspond to their respective intermediate voltage generators. For example, the first intermediate voltage detector 109 may have a threshold value of +200V and the second intermediate voltage detector may have a threshold value of −200V. The first intermediate voltage generator 105 may be operative to output a signal of +220V and the second intermediate voltage generator 107 may be operative to output a signal of −220V. The difference in the signals and thresholds helps to ensure that the output signal of one of the intermediate voltage generators 105/107 will only affect the output of its corresponding intermediate voltage detector 109/111. The voltages of the generated intermediate arming signals may also be chosen to be dissimilar from other voltages in the system 100 to reduce the chances that common power sources, noise, or interference from other voltage sources in the system will not affect the output of the intermediate voltage detectors 109 and 111. Example common power sources are batteries, 110 Vac, etc. The signals output from the intermediate voltage generators 105 and 107 and the detection thresholds may include any appropriate values according to design specifications of embodiments of the system 100.

The first intermediate voltage detector portion 109 outputs a signal ($A_1$) to the sequence of event logic portion 106 when a voltage signal $V_1$ from the intermediate voltage generator is received that is above the threshold value $T_1$. Likewise, the second intermediate voltage detector portion 111 outputs a signal ($A_2$) to the sequence of event logic portion 106 when a voltage signal $V_2$ from the intermediate voltage generator is received that is above the threshold value $T_2$. The sequence of events logic portion 106 determines the signal $A_1$ was received prior to receiving the signal A2. If the signal $A_1$ was received prior to the signal $A_2$, the sequence of events logic portion 106 actuates the second arm switch 114 by affecting the closing of the second arm switch 114.

When the first arm switch 110 is closed, the second arm switch 112 is closed, and the third arm switch 114 is alternately closed and opened, the voltage source 108 charges the capacitor discharge unit 118 via the inductive device 116. In the illustrated embodiment, the ignition logic portion 122, which may include any type of logic device or human input, may actuate the ignition switch 120. When the ignition switch is actuated (i.e., closed) the capacitor discharge unit 118 discharges to the initiator 124, which ignites the energetic device 126.

Figure 2:
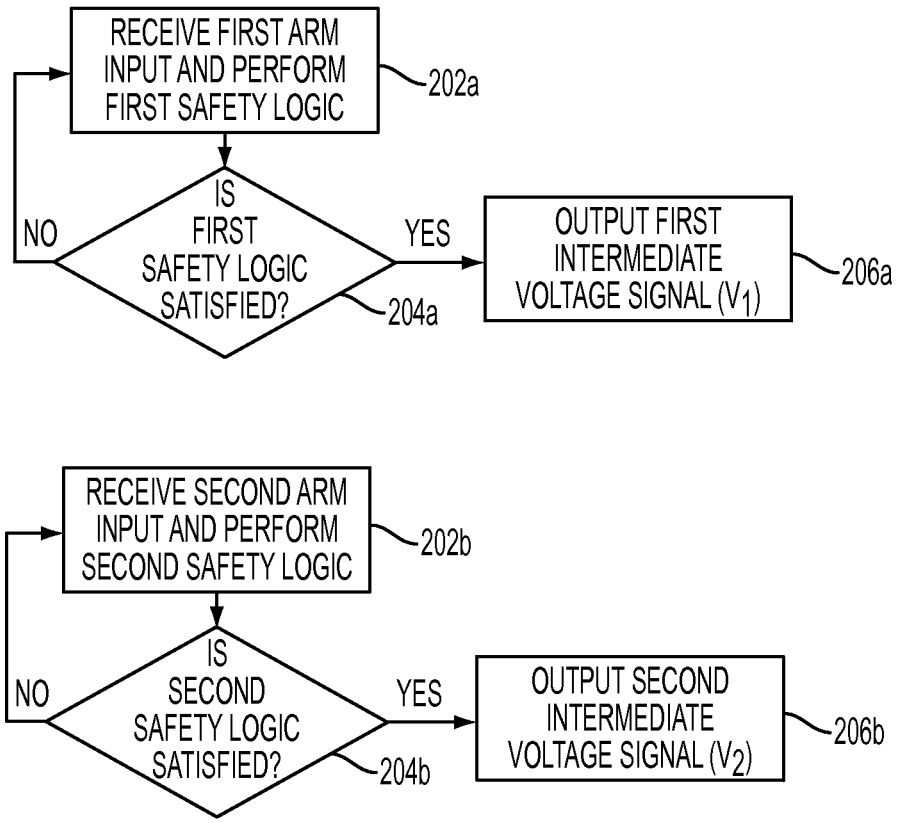
FIG. 2 illustrates a block diagram of an exemplary method of operation of the arm controller portion of FIG. 1.

FIG. 2 illustrates a block diagram of an exemplary method of operation of the arm controller portion 101 (of FIG. 1). In this regard, in block 202*a*, the arm controller portion 101 receives a first external arm input and performs a first safety logic routine. If the first safety logic routine is satisfied in block 204*a*, the arm controller portion 101 outputs the first intermediate voltage signal $V_1$ in block 206*a*. In block 202*b*, the arm controller portion 101 receives a second external arm input and performs a second safety logic routine. If second first safety logic routine is satisfied in block 204*b*, the arm controller portion 101 outputs the second intermediate voltage signal $V_2$ in block 206*b*.

Figure 3:
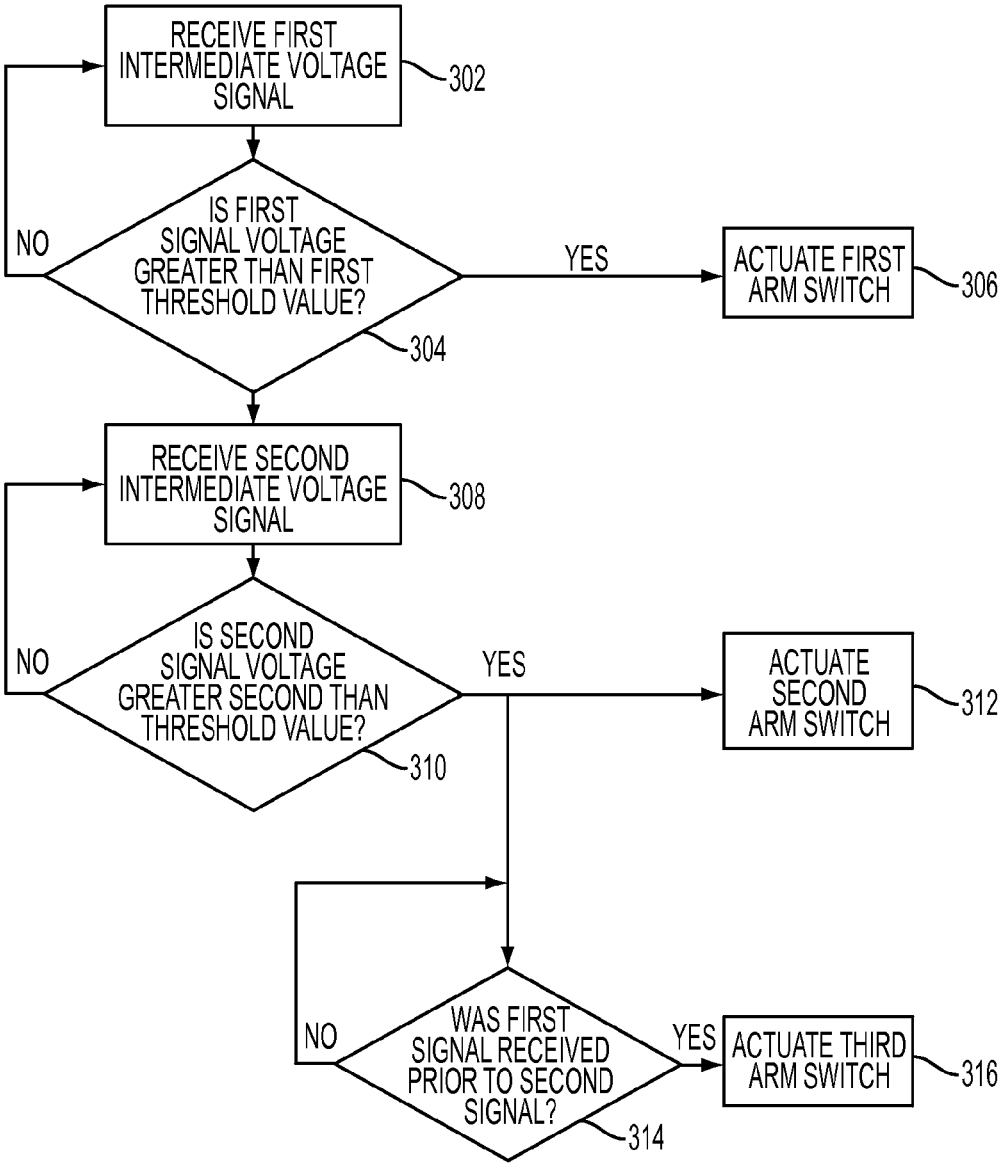
FIG. 3 illustrates a block diagram of an exemplary method of operation of the arm and fire device (AFD) of FIG. 1.

FIG. 3 illustrates a block diagram of an exemplary method of operation of the arm and fire device (AFD) 103 (of FIG. 1). In this regard, in block 302, the AFD 103 receives a first intermediate voltage signal ($V_1$). The AFD 103 determines whether the $V_1$ signal is greater than a first threshold value ($T_1$) in block 304. If yes, the AFD 103 affects the actuation of the first arm switch 110 in block 306. In block 308, the AFD 103 receives the second intermediate voltage signal ($V_2$). The AFD 103 determines whether the $V_2$ signal is greater than a second threshold value ($T_2$) in block 310. If yes, the AFD 103 affects the actuation of the second arm switch 112 in block 312. In block 314, the AFD 103 determines whether the $V_1$ signal was received prior to the $V_2$ signal. If yes, the AFD 103 affects the actuation of the third arm switch 114 in block 316.

Figure 4:
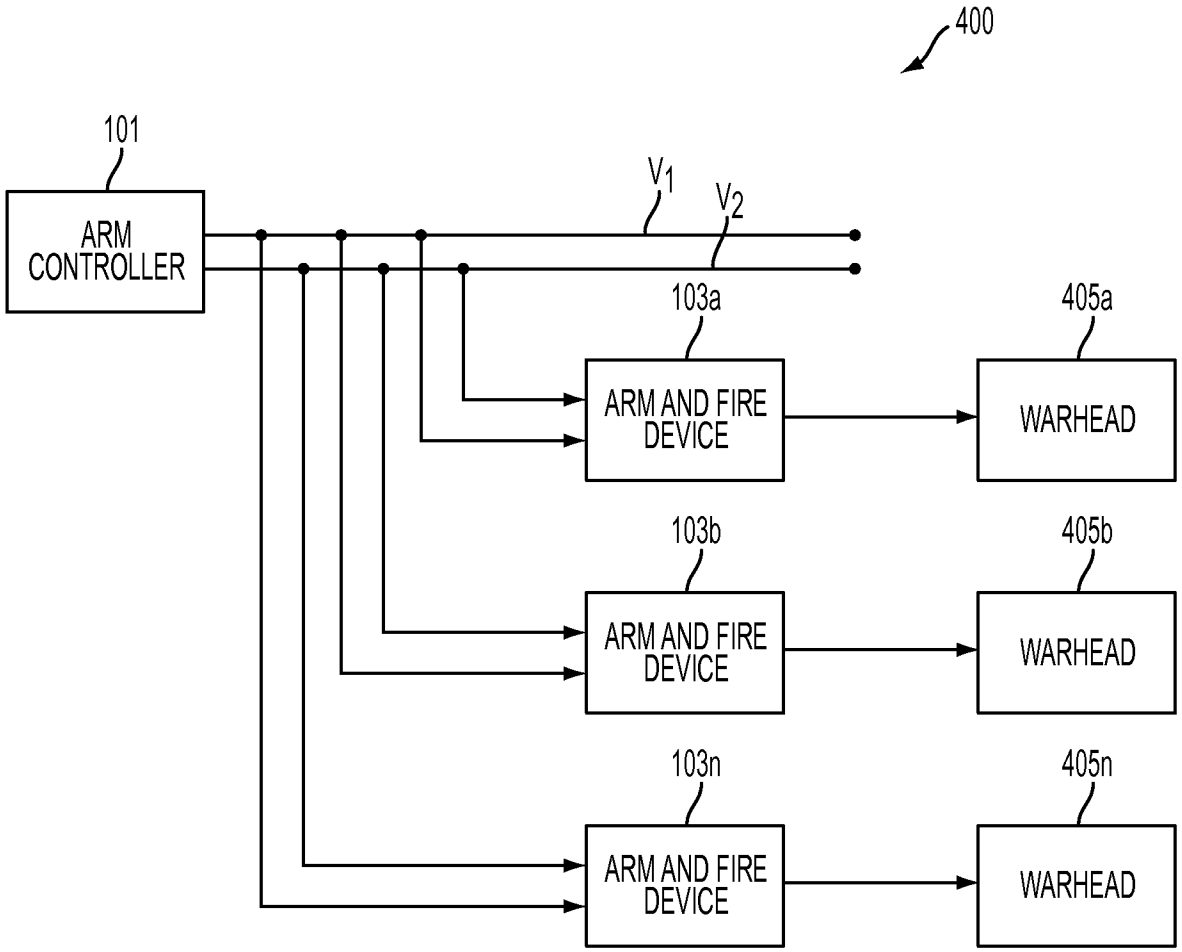
FIG. 4 illustrates a block diagram of an exemplary embodiment of a system.

FIG. 4 illustrates a block diagram of an exemplary embodiment of a system 400. In this regard, the system 400 includes an arm controller 101 and a plurality of AFDs 103*a-n*. Each AFD 103*a-n* is communicative with a corresponding warhead portion 405*a-n*. Thus, a single arm controller 101 may be operative to send signals to any number of arm and fire devices 103 affecting the ignition of any number of warheads 405.

Figure 5:
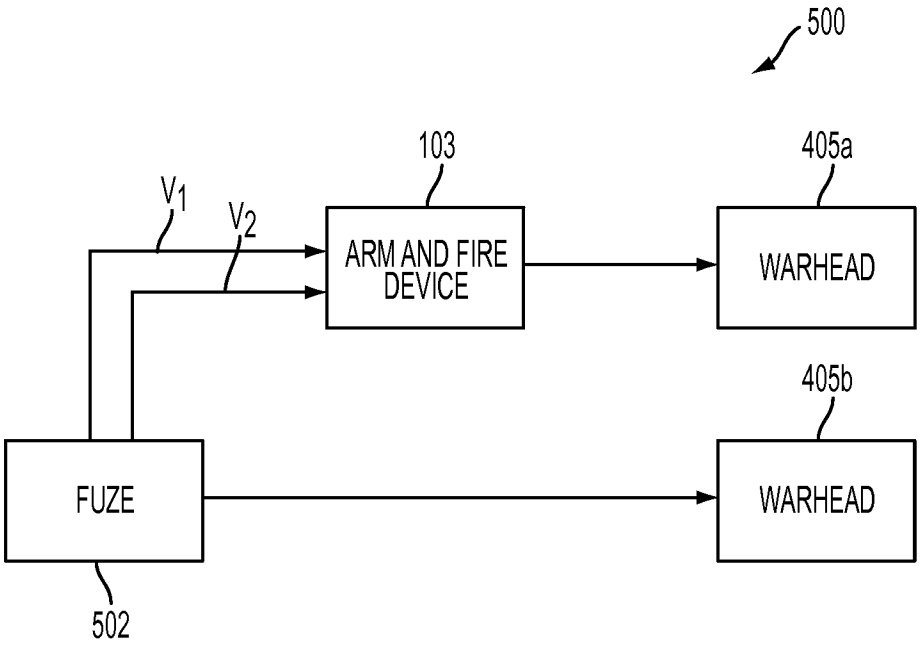
FIG. 5 illustrates a block diagram of an exemplary embodiment of a system.

FIG. 5 illustrates a block diagram of an exemplary embodiment of a system 500. In this regard, the system 500 includes a fuze 502 that is operative to output a first voltage signal V1 and a second voltage signal V2 to an AFD 103. The AFD 103 is operative to affect the ignition of a warhead 405*a*. The fuze 502 is also operative to affect the ignition of a second warhead 405*b*.

Figure 6:
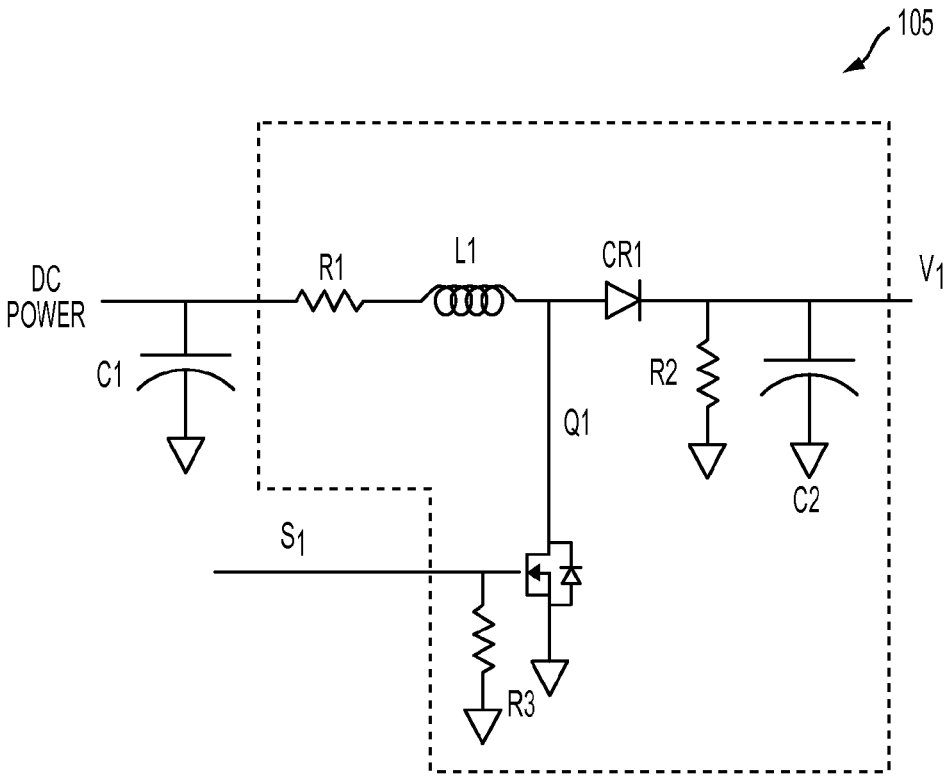
FIG. 6 illustrates circuit diagram of an exemplary embodiment of an intermediate voltage generator.

FIG. 6 illustrates circuit diagram of an exemplary embodiment of an intermediate voltage generator 105. In this regard, the circuit includes a switching device Q1 that receives the $S_1$ signal. The circuit receives DC power and outputs the voltage signal $V_1$ responsive to receiving the $S_1$ signal. In the illustrated exemplary embodiment, the intermediate voltage generator 105 is operative to output a positive polarity voltage signal. The specifications of, for example, the DC power source and the other elements of the circuit may be selected to output any desired voltage signal $V_1$. Alternate embodiments of the intermediate voltage generator 105 may be arranged to output a negative polarity voltage signal if desired.

Figure 7:
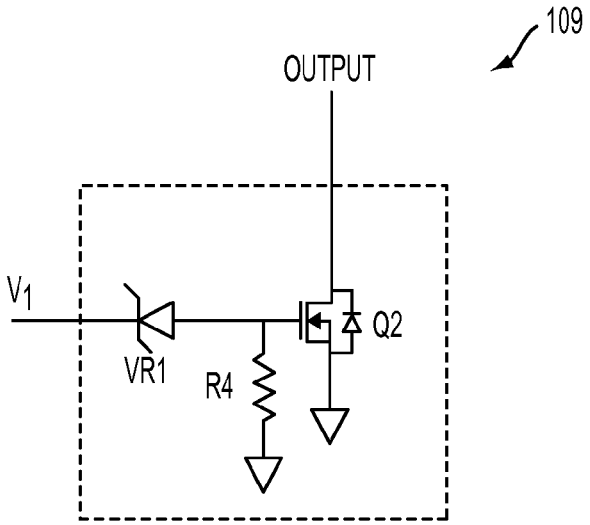
FIG. 7 illustrates a circuit diagram of an exemplary embodiment of an intermediate voltage detector.

FIG. 7 illustrates a circuit diagram of an exemplary embodiment of an intermediate voltage detector 109. In this regard, the diode VR1 is selected to define the threshold value $T_1$ described above. In this regard, if the $V_1$ voltage is above the threshold value $T_1$, the state of the switching device Q2 will change. The output of the intermediate voltage detector 109 may include the $A_1$ signal to the sequence of events logic 106 and an actuation signal operative to actuate the first arm switch 110 as illustrated in FIG. 1. Alternate embodiments of the intermediate voltage detector 109 may be arranged to receive a negative polarity voltage signal if desired.

Figure 8:
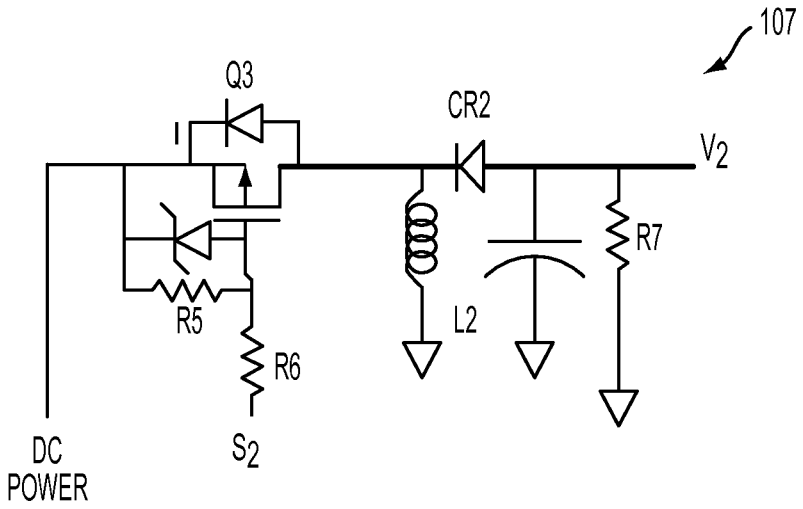
FIG. 8 illustrates circuit diagram of an exemplary embodiment of an intermediate voltage generator.

FIG. 8 illustrates circuit diagram of an exemplary embodiment of an intermediate voltage generator 107. In this regard, the circuit operates in a similar manner as the intermediate voltage generator 105 described above in FIG. 6; however, the circuit is operative to output a voltage signal $V_2$ having a negative polarity responsive to receiving the $S_2$ signal.

Figure 9:
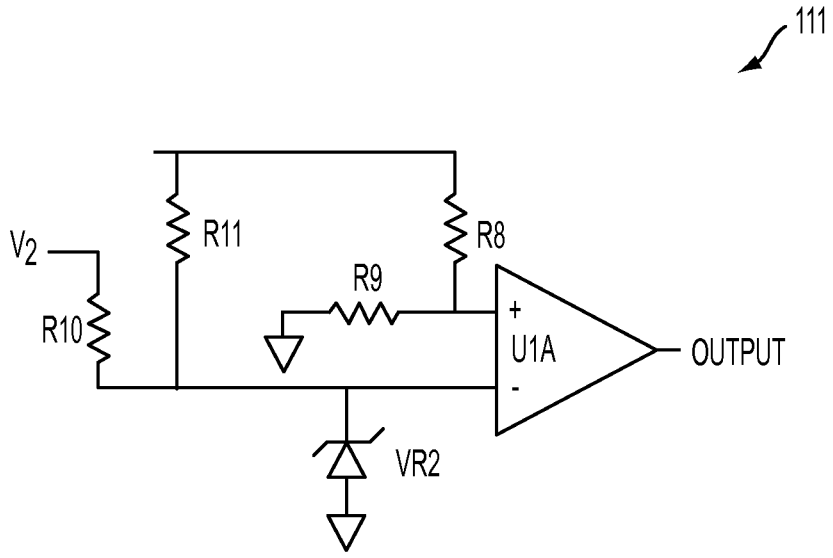
FIG. 9 illustrates a circuit diagram of an exemplary embodiment of an intermediate voltage detector.

FIG. 9 illustrates a circuit diagram of an exemplary embodiment of an intermediate voltage detector 111. In this regard, circuit operates in a similar manner as the intermediate voltage detector 109 described above in FIG. 7; however, the R10/R11 resistance ratio is selected to define the threshold value $T_2$ described above. The circuit includes a comparator U1A that is operative to output a signal responsive to the $V_2$ voltage signal being greater than the $T_2$ threshold. The output signal affects the output of the $A_2$ signal to the sequence of events logic 106 and an actuation signal operative to actuate the third arm switch 112 as illustrated in FIG. 1.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. An arming system comprising:

a first arm switch;

an inductive device connected in series with the first arm switch;

a second arm switch connected in series with the inductive device;

a third arm switch connected in series with the second arm switch;

a sequence of events logic portion operative to receive a first arm signal and a second arm signal and determine whether the first arm signal was received prior to receiving the second arm signal and affect an actuation of the second arm switch responsive to determining that the first arm signal was received prior to receiving the second arm signal;

a first logic portion operative to perform a first logic routine and output a first signal;

a first intermediate voltage generator portion communicatively connected to the first logic portion, the first intermediate voltage generator portion operative to receive the first signal and output a first intermediate voltage signal; and a first intermediate voltage detector portion communicatively connected to the first intermediate voltage generator portion and the sequence of events logic portion, the first intermediate voltage detector portion operative to determine whether the first intermediate voltage signal is greater than a first threshold voltage value and responsive to determining that the first intermediate voltage signal is greater than the first threshold voltage value affect an actuation of the first arm switch and output the first arm signal to the sequence of events logic portion.

2. The system of claim 1, wherein the system further comprises:

a second logic portion operative to perform a second logic routine and output a second signal;

a second intermediate voltage generator portion communicatively connected to the second logic portion, the second intermediate voltage generator portion operative to receive the second signal and output a second intermediate voltage signal;

a second intermediate voltage detector portion communicatively connected to the second intermediate voltage generator portion and the sequence of events logic portion, the second intermediate voltage detector portion operative to determine whether the second intermediate voltage signal is greater than a second threshold voltage value and responsive to determining that the second intermediate voltage signal is greater than the second threshold voltage value affect an actuation of the third arm switch and output the second arm signal to the sequence of events logic portion.

3. The system of claim 2, wherein the first logic portion and the second logic portion partially define an arm controller.

4. The system of claim 2, wherein the second logic portion is operative to receive an input, and perform the second logic routine and output the second signal responsive to receiving the input and completing the second logic routine.

5. The system of claim 1, wherein the system further comprises:

a voltage multiplier;

a capacitor discharge unit; and an initiator connected to a discharge terminal of the capacitor discharge unit.

6. The system of claim 5, wherein the system further comprises an explosive device arranged proximate to the initiator, the explosive device operative to combust responsive to a combustion of the initiator.

7. The system of claim 1, wherein the first logic portion is operative to receive an input, and perform the first logic routine and output the first signal responsive to receiving the input and completing the first logic routine.

* * * * *